United States Patent [19]

Hennings

[11] 3,964,627

[45] June 22, 1976

[54] CONTAINER FOR AN INJECTION LIQUID, IN THE FORM OF A FLASK CLOSED BY A CURL-ON CAP

[75] Inventor: Werner Hennings, Bunde, Germany

[73] Assignee: Bunde Glass GmbH, Bunde, Germany

[22] Filed: Oct. 15, 1973

[21] Appl. No.: 406,428

[30] Foreign Application Priority Data

Dec. 15, 1972 Germany ..... 7245858[U]

[52] U.S. Cl. ..... 215/247; 215/31; 215/328; 215/337

[51] Int. Cl.[2] ..... B65D 41/50

[58] Field of Search ..... 215/247, 324, 328, 337, 215/339, DIG. 3, 31

[56] References Cited

UNITED STATES PATENTS

| | | | |
|---|---|---|---|
| 1,650,440 | 11/1927 | Glacken | 215/31 |
| 1,796,728 | 3/1931 | Sharp | 215/324 |
| 2,827,193 | 3/1958 | Martin | 215/31 |
| 3,124,273 | 3/1964 | Remington | 215/31 |
| 3,169,655 | 2/1965 | Little | 215/324 |
| 3,784,040 | 1/1974 | Douglas | 215/31 |
| 3,805,986 | 4/1974 | Gaudin | 215/DIG. 3 |

*Primary Examiner*—Herbert F. Ross
*Attorney, Agent, or Firm*—Neil F. Markva

[57] ABSTRACT

A container for an injection liquid, in the form of a flask closed by a curl-on cap, and having a neck which on its external circumference is provided all round with projecting ridges or recessed grooves which engage or are engaged by the internal surface of the curl-on cap when this is pressed on with the application of heat.

9 Claims, 3 Drawing Figures

CONTAINER FOR AN INJECTION LIQUID, IN THE FORM OF A FLASK CLOSED BY A CURL-ON CAP

BACKGROUND OF THE INVENTION

This invention relates to a container for an injection liquid, in the form of a flask or bottle closed by a curl-on cap.

Containers having the form of flasks are generally known in the art. Among specifically known containers are flasks for the reception of liquids that are to be injected.

After having been filled with the injection liquid such containers are closed by curling on a synthetic plastics cap. In order to permit the cap to be curled over the container mouth the neck of the usually cylindrically shaped container is provided with a bulbous rim, flange or collar.

The injection liquid is removed from the container by suction with the aid of a plunger after the curl-on cap has been pierced by the canule of a syringe.

The above-described container can also be used for a so-called two-chamber syringe. Details of such two-chamber syringes have already been described elsewhere, and as such they form no part of the present invention.

The curl-on cap is secured to a conventional flask-shaped container, which has been filled with an injection liquid, with the application of heat. Usually the heat is provided by a stream of hot air. However, it is a defect of containers closed with a curl-on cap that the external circumference of the container neck as well as the internal circumference of the cap are both smooth and that it is possible to twist the curl-on cap after it has been applied.

SUMMARY OF THE INVENTION

In view of this defect it is the object of the invention to provide an improved type of flask-like container for the reception of an injection liquid, which has a neck which ensures that the cap is firmly seated on the container and which prevents the cap from being twisted.

To attain this object the present invention provides a container for an injection liquid, in the form of a flask having a neck and a curl-on cap having an external and an internal surface, said neck being provided with outer corrugations which are in engagement with the internal surface of the curl-on cap when this is pressed on with the application of heat.

According to another feature of the invention the ridges or grooves on the neck may extend from above downwards or encircle the neck.

Preferably, the body of the container having the neck provided with such ridges or grooves consists of glass, whereas the curl-on cap is made of a synthetic plastics material.

BRIEF DESCRIPTION OF THE DRAWING

An embodiment of the invention will now be described by way of example and with reference to the accompanying drawing, in which.

DESCRIPTION OF THE PREFERRED EMBODIMENT

Figure 1:
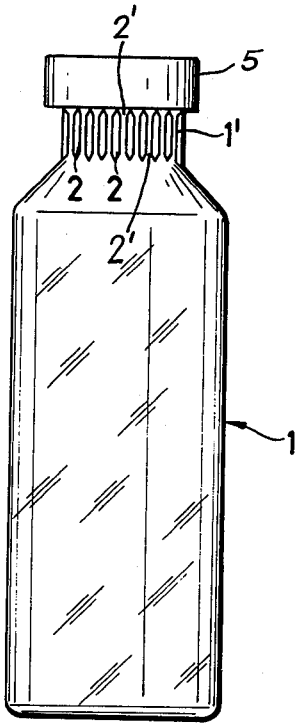
FIG. 1 is a side elevation of a container according to the invention without a curl-on cap.
Figure 2:
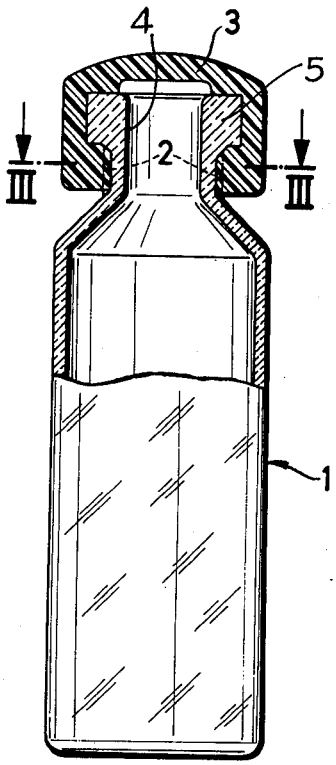
FIG. 2 is a side elevation, partly in section, of the container of FIG. 1 after having been closed by pressing on the curl-on cap, likewise shown in section.
Figure 3:
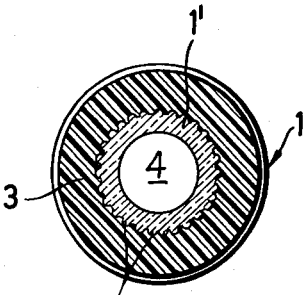
FIG. 3 is a section taken on the line III — III of FIG. 2

Referring to the drawings, a container 1 comprises a bottle including a mouth 4 and a reduced neck portion 1' having an outer surface area with a plurality of recesses 2'. In this particular embodiment, the recesses 2' are defined between projecting ridges 2 that are disposed around the circumference of the neck portion 1'. Alternatively, the recesses 2' may be defined by grooves extending into the outer surface area and disposed around the circumference of the neck portion 1' as shown.

In this particular embodiment, the neck portion 1' includes a flange portion 5 located completely around the mouth 4. The outer surface area containing the ridges 2 and recesses 2' are disposed immediately adjacent the flange portion 5. The projecting ridges 2 constitute a plurality of corrugations extending vertically along the outer surface area of the neck portion 1'. Alternatively, the recesses 2' may be defined by a plurality of annular corrugations laterally spaced vertically along the outer surface area of the neck portion 1'.

The bottle or container 1 is composed of glass and the cap 3 is composed of a material that is flowable when heat is applied thereto. In this particular embodiment, the cap material is a synthetic plastics material. The cap has an external and an internal surface.

The cap 3 of this invention is placed over the mouth 4 of the container and pinched together around the neck portion 1' with the application of heat. This heat may be applied in the form of hot air. In other words, the cap 3 is separately disposed around the circumference of the neck portion 1' by applying heat thereto thereby causing the material in the cap to flow into a conformed contiguous relationship with respect to the recesses 2'. That is, during the heat applying process, the plastics material becomes hot and penetrates into the gaps or recesses 2' located between the projecting ridges 2. If the recesses 2' are defined by grooves instead of ridges 2, the plastics material will become anchored in the grooves.

Once the cap material has flowed around the neck portion 1' so that the cap is conformed in a contiguous relationship to the recesses of the outer surface area, the cap is firmly seated on the bottle or container 1 and is prevented from being twisted while disposed on the neck portion 1'. The formation of the neck portion 1' in the described manner affords the cap 3 a firm grip on the neck portion 1' and contrary to conventional caps, it cannot be twisted.

The invention may be embodied in other specific forms without departing from the spirit or essential characteristics thereof. The embodiment is therefore to be considered in all respects as illustrative and not restrictive.

What is claimed is:

1. A container for an injection liquid comprising:

a. a bottle including a mouth having an outwardly extending flange disposed completely around said mouth. and a reduced neck portion having an outer surface area with a plurality of parallel axially aligned recesses disposed around the circumference of said neck portion, and b. a cap composed of a material that is flowable when heat is applied thereto and having an external and an internal surface, c. said material of the cap being conformed in contiguous relationship along its internal surface to the recesses of the outer surface area of the neck portion, d. whereby the cap is firmly seated on the bottle and is prevented from being twisted while disposed on the neck portion.

2. A container as defined in claim 1 wherein:

the recesses are defined between projecting ridges that are disposed around the circumference of the neck portion.

3. A container as defined in claim 1 wherein the recesses are defined by grooves extending into the outer surface area of the neck portion and are disposed around the circumference of the neck portion.

4. A container as defined in claim 1 wherein said outer surface area of the neck portion is disposed immediately adjacent the flange, and the cap material is conformed in contiguous relationship to the flange portion.

5. A container as defined in claim 4 wherein the recesses are defined between projecting ridges that are disposed around the circumference of the neck portion.

6. A container as defined in claim 1 wherein the recesses are defined by a plurality of corrugations extending vertically along said outer surface area.

7. A container as defined in claim 1 wherein the recesses are defined by a plurality of annular corrugations laterally spaced vertically along said outer surface area.

8. A container as defined in claim 1 wherein the container is composed of glass and the cap material is a synthetic plastics material.

9. A container as defined in claim 1 wherein the cap is separately disposed around the circumference of the neck portion by applying heat to cause the material to flow into a conformed contiguous relationship with respect to said recesses.

* * * * *